US005769234A

United States Patent [19]

Gueret

[11] Patent Number: 5,769,234

[45] Date of Patent: Jun. 23, 1998

[54] TRANSPARENT CARE-PRODUCT CONTAINER

[75] Inventor: Jean-Louis H. Gueret, Paris, France

[73] Assignee: L'Oreal, Paris, France

[21] Appl. No.: 670,573

[22] Filed: Jun. 26, 1996

[30] Foreign Application Priority Data

Jun. 26, 1995 [FR] France ..... 95 07665

[51] Int. Cl.[6] ..... A45D 40/22; A45D 33/16; A45D 33/22

[52] U.S. Cl. ..... 206/581; 206/542; 206/75.5; 132/314

[58] Field of Search ..... 206/581, 823, 206/542, 745, 749, 755, 763, 776, 777, 778; 132/314, 315, 316; 220/DIG. 26, 324, 326

[56] References Cited

U.S. PATENT DOCUMENTS

| | | | |
|---|---|---|---|
| D. 144,533 | 4/1946 | Worley | 206/581 |
| 2,399,997 | 5/1946 | Flaster | 220/DIG. 26 |
| 3,394,838 | 7/1968 | Larkin | 220/326 |
| 3,674,039 | 7/1972 | Vastano . | |
| 3,911,936 | 10/1975 | Kingsford | 132/316 |
| 4,696,317 | 9/1987 | Shioi et al. | 132/314 |
| 4,821,751 | 4/1989 | Chen | 206/581 |
| 4,826,014 | 5/1989 | Schefer | 206/581 |
| 5,431,177 | 7/1995 | Kecman | 206/581 |

FOREIGN PATENT DOCUMENTS

| | | | |
|---|---|---|---|
| 615710-A1 | 3/1994 | European Pat. Off. | 132/314 |
| 2522943 | 9/1983 | France | 206/823 |
| 2 600 240 | 12/1987 | France . | |
| 0 385 837 | 9/1990 | France . | |
| 2 686 784 | 8/1993 | France . | |
| 2 691 339 | 11/1993 | France . | |
| 2 702 635 | 9/1994 | France . | |

*Primary Examiner*—Paul T. Sewell
*Assistant Examiner*—Anthony Stashick
*Attorney, Agent, or Firm*—Oblon, Spivak, McClelland, Maier & Neustadt, P.C.

[57] ABSTRACT

An arrangement for packaging a cosmetic product includes a container which includes a receptacle, a plate, possibly a lid and a base piece, and a mechanism for fixing the plate on the receptacle, this receptacle being transparent and obtained without any undercuts. In particular, this receptacle is made of glass or of cast resin.

14 Claims, 5 Drawing Sheets

TRANSPARENT CARE-PRODUCT CONTAINER

BACKGROUND OF THE INVENTION

1. Field of the Invention

The subject of the invention is a new packaging arrangement for care products, which can be used more especially in the field of cosmetics, but also in any other field.

2. Discussion of the Background

Care products are generally in the form of compositions of a rather fluid appearance, such as creams, milks, ointments, gels, cream gels. They are therefore generally packaged in tubes, bottles or alternatively in pots which are taller than they are long or wide.

Now, new technologies in the field of cosmetics allow the manufacture of new textures of care creams. These creams are more pasty formulae which the user has to take up on a finger. Packaging them with a view to their daily or repeated use therefore requires a larger surface area and a take-up surface situated not so deep down. It therefore seems that the packaging known hitherto and mentioned hereinabove for care products is unsuited to the storage of these new products.

It is also very important for the user of these care products to be able to identify quickly and unambiguously the nature of the packaged product, for example without even having to open the packaging, thus avoiding any possible external pollution or contamination.

It is also advantageous to give this packaging, which may be required to contain luxury products, an attractive aesthetic appearance.

Applicant has therefore sought out new packaging for these new products, such as an extra-flat container like those used for powders in the field of make-up, and has sought to make this in a transparent material such as glass or a transparent resin.

Make-up containers made of glass already exist in the prior art (for example Patent Application FR-A-2,702,635). These containers conventionally comprise two parts, namely a plate and a receptacle, which are articulated about a hinge. However, in order to compensate for dimensional variation which is due to the very wide tolerances in molding glass, these containers are composed of a great many intermediate components made of plastic which have to be fixed by snap-fastening onto components made of glass, the latter having glass projections molded with said glass components. These glass components are complicated and tricky to produce. The result of this is that the manufacture of these containers is lengthy and complicated. The cost of these containers is therefore high and does not allow production on an industrial scale to be envisaged, even for luxury products.

This is why Applicant has produced a container without projections so as to allow easy molding in glass or in cast resin, and also compacting of a care product directly in the container.

SUMMARY OF THE INVENTION

The subject of the invention is therefore a new arrangement for packaging a cosmetic product, including a container comprising a receptacle, a plate and means for fixing the plate on the receptacle, characterized in that the receptacle is transparent and is obtained without any undercuts.

The packaging arrangement according to the present invention comprises a container composed conventionally of a receptacle and of a plate. Depending on the various embodiments of the invention, the plate may itself form a lid or alternatively include a separate lid articulated about a hinge. The invention is based on the fact that the receptacle is a piece of glass or resin, one of the features of which is that it has no projections and can therefore be cast and molded so as to obtain a pure component without any optical reflections due to complicated undercuts.

The receptacle includes at least one passage, which may be cylindrical or some other shape, and the plate may be equipped with one or more attachment feet which, snap-fastened or snap-fitted into the passage or passages in order to attach the plate, the receptacle and possibly the lid.

The plate and, as appropriate, the lid may be made of plastic or of a precious material (metal).

The packaging arrangement thus produced therefore comprises a molded receptacle obtained without any undercuts. It thus has the advantage of a very pure (simple) shape and of being able to be manufactured on an industrial scale very simply and at a relatively modest cost.

The container according to the invention also has the advantage of being extra flat and is thus perfectly suited to the packaging of the new textures of compact care creams. In particular, the ratio of the height of the container to its length or its width is less than 0.2.

Finally, making it from glass or from cast resin gives it a very attractive aesthetic appearance and allows the user immediately to identify its contents without having to open the container.

In other embodiments of the invention, the container may further include a base piece separate from the receptacle. This base piece may also be fitted with fixing means which interact with the attachment foot or feet of the plate and/or with the passage or passages of the receptacle. The receptacle is therefore sandwiched between the lid and the base piece. In this specific embodiment of the invention the base piece, which may be made of plastic or of a precious material (metal), may thus hide any defects in the piece of glass.

BRIEF DESCRIPTION OF THE DRAWINGS

The invention and the implementation thereof will appear more clearly with the aid of the following description, given with reference to the attached Figures in which.

DESCRIPTION OF THE PREFERRED EMBODIMENTS

Figure 1:
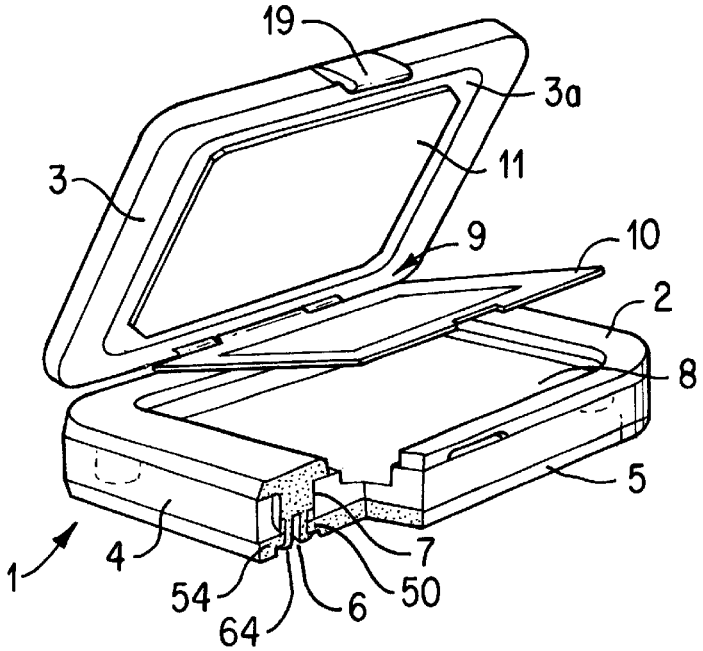
FIG. 1 is a perspective view of a complete container in accordance with the invention.
Figure 2:
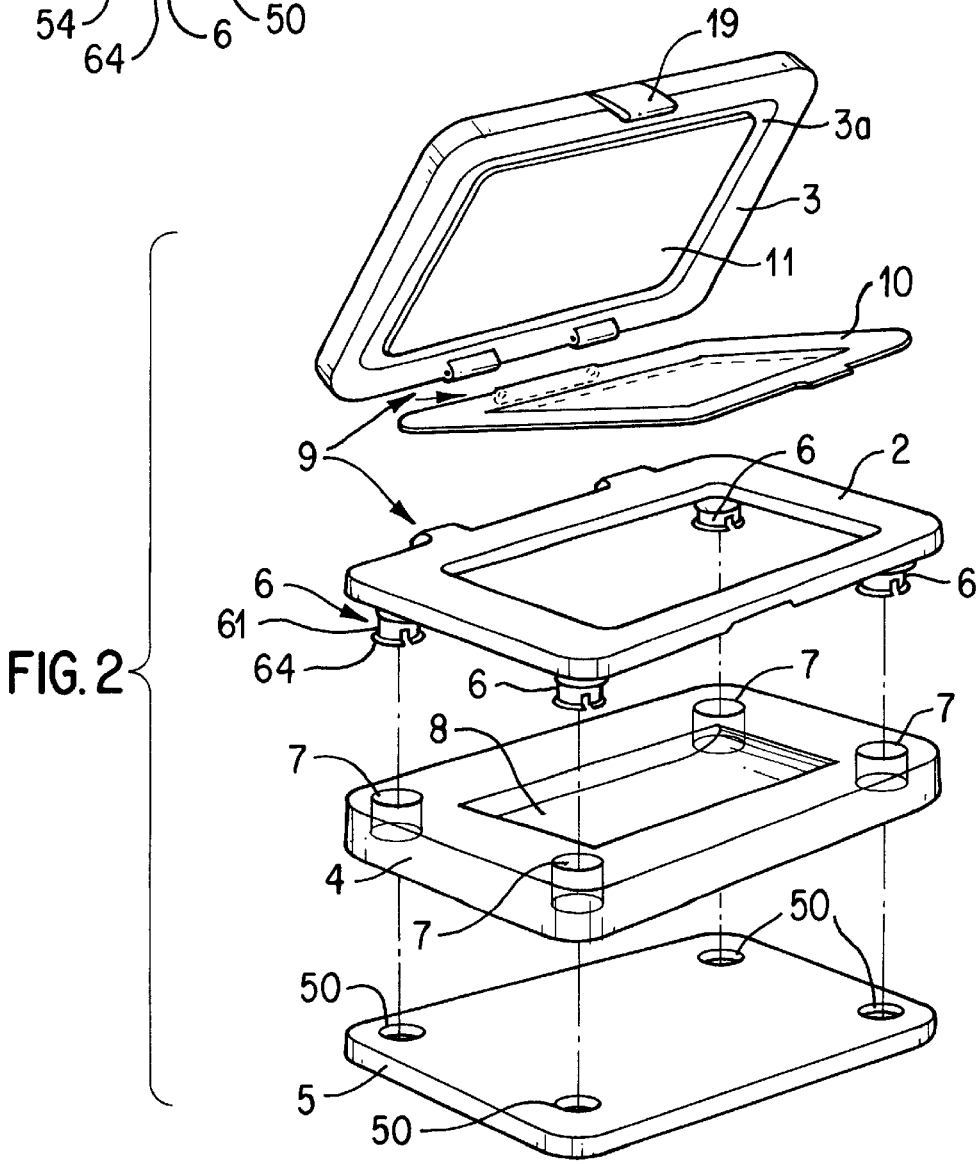
FIG. 2 is an exploded view of the container of FIG. 1.
Figure 3:
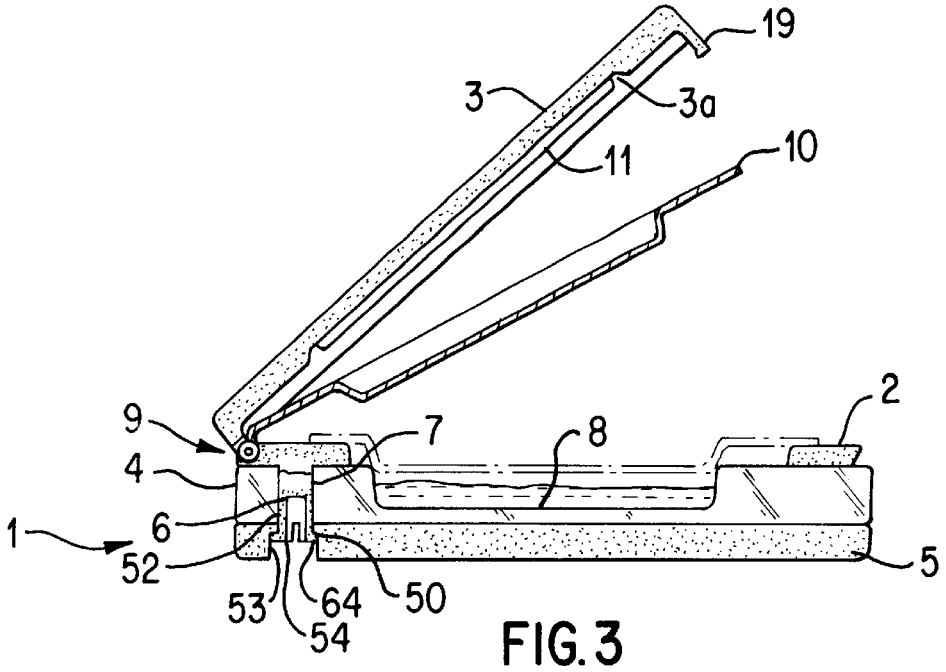
FIG. 3 is a sectional view of the container of FIG. 1.
Figure 4:
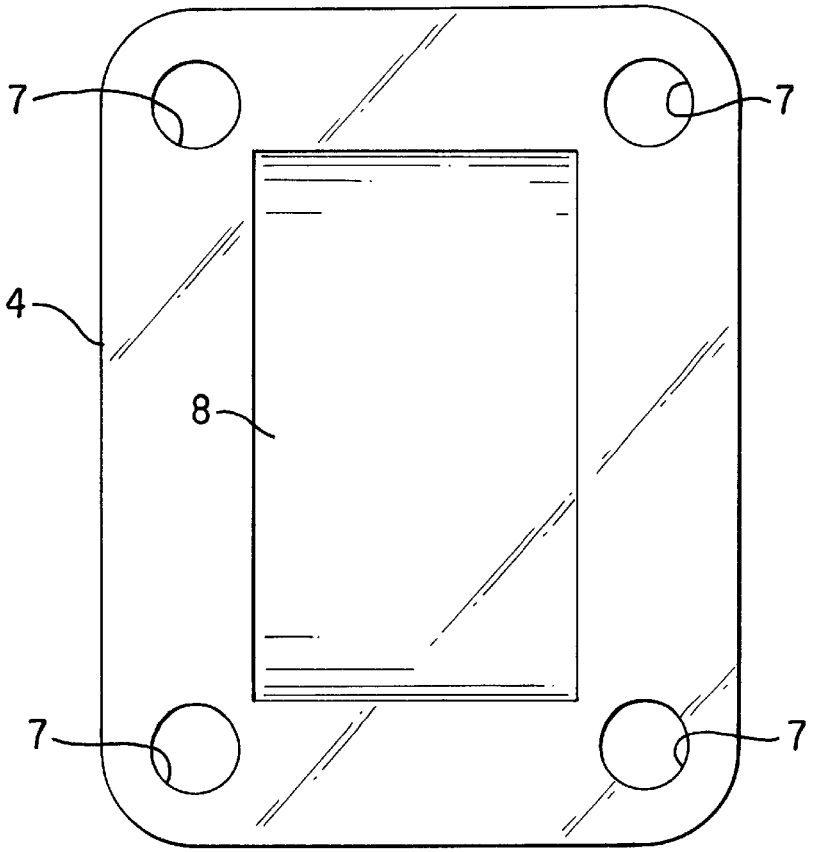
FIG. 4 is a plan view of the receptacle of FIG. 1.

In the embodiment illustrated in FIGS. 1 to 4, the container generally referenced 1 essentially includes a plate 2, to which a lid 3 is articulated about a hinge 9, and a glass receptacle 4. The container 1 also includes a base piece 5. The base piece 5 includes four holding passages 50, each of them being made in two cylindrical parts, namely an upper part 52 and a lower part 53, these two parts defining a stop 54. As may be seen in FIG. 2, the plate 2 includes attachment feet 6 assembling the receptacle 4 with the plate 2 via cylindrical passages 7, the diameter of which is constant and which are formed on the receptacle 4 along the same axis as the holding passages 50 in the base piece 5. The passages 7 are situated at the four corners of the receptacle and are incorporated into the perfect parallel-piped formed by the receptacle. Corresponding with each passage 7 of the receptacle 4 is a passage 50 in the base piece 5 and, opposite it on the plate 2, an attachment foot 6 whose height is slightly greater than that of the passage 7. The attachment feet 6 have a cylindrical part 61 whose diameter is smaller than that of the passages 7 and the outwardly curving end of which forms a cylindrical skirt 64 bearing against the stop 54 defined by the two cylindrical parts 52 and 53 of the holding passage 50 of the base piece 5. The receptacle 4 comprises a housing 8 for the product, especially a face-care cream having the appearance of a poured make-up product. This receptacle 4 has no projections. The container 1 also includes a cover 10 which serves to protect the product and which is articulated about the hinge 9. This cover mates with the housing 8 for the product and in its middle part has the shape of a dish. The lid 3 comprises a mirror 11 on its internal face 3*a*. The container 1 is also equipped with a clasp 19, built into the lid, which snap-fastens over the plate 2 when the container is in its closed position.

The receptacle 4 as represented in FIGS. 1 to 4 has the shape of a parallel-piped of which one of the three dimensions, namely the height h, is much smaller than the other two, namely the length L and the width l. In a preferred embodiment of the invention, the ratios h/l and h/L, which may be identical or different, are less than 0.2 and preferably range from 0.07 to 0.12.

The receptacle may be manufactured very simply by melting glass or pouring resin into a two-part mold of a parallelepipedal shape, the two mold parts being equipped with spikes at the sites of the holding passages, the part forming the lid including a protrusion at the site of the housing for the product.

In other embodiments of the invention, the lid may also include an O-ring intended to provide a seal between the plate and the lid.

In other embodiments of the invention, the clasp may engage in a concave notch formed on an external surface of the receptacle or alternatively be formed of two separate elements, one incorporated into the lid and the other into the base piece. When the base piece is made of plastic a clasp is then obtained which is more elastic, more flexible and more comfortable.

In another embodiment of the invention, the hinge may be a film hinge made of polypropylene.

In some embodiments of the invention, the base piece may also comprise storage housings which can contain any kind of product, especially make-up products.

Various embodiments of the means for fixing the plate on the receptacle are represented in FIGS. 5*a* to 5*e*.

FIGS. 5*a* to 5*e* represent the means for fixing the plate 2 to the receptacle 4 in the specific invention embodiment in which the container 1 does not have a base piece.

Figure 5A:
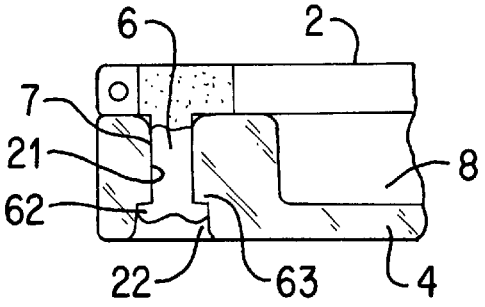
FIGS. 5*a* to 5*e* represent various systems for attaching the elements of the container to each others FIG. 5*d* being a sectional view taken along line D—D of FIG. 5*c* and FIG. 5*c* being a section taken along line C—C of FIG. 5*d;*

More specifically, in FIG. 5*a*, the passage or passages 7 of the receptacle 4 consist of two coaxial cylindrical hollow parts, an upper cylindrical part 21 directed towards the plate 2 and a lower cylindrical part 22, of different diameters but with the diameter of the lower part 22 greater than that of the upper part 21. Each attachment foot 6 here is snap-fitted into the corresponding holding passage 7. The foot 6 has a peripheral collar 62 bearing against the stop 63 defined between the two cylindrical parts 21 and 22.

Figure 5B:
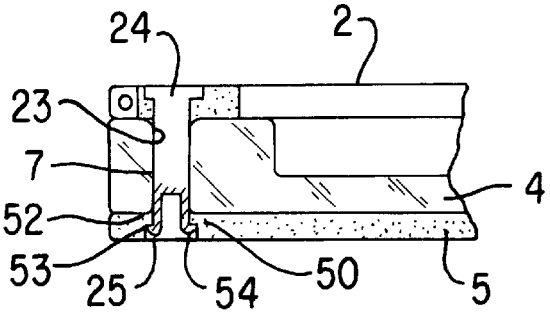
Figure 5C:
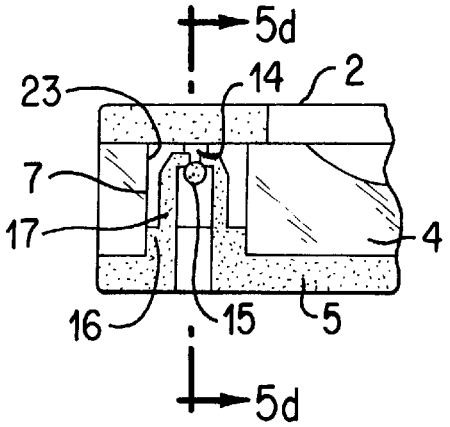
Figure 5D:
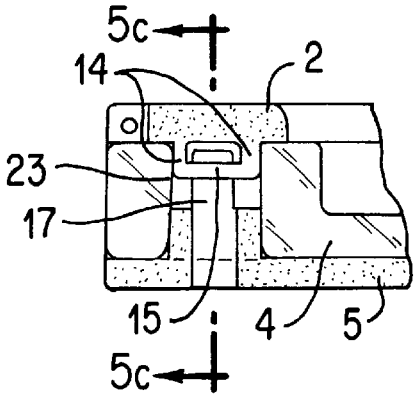
Figure 5E:
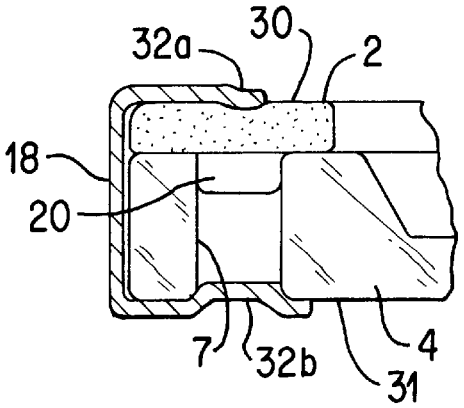

FIG. 5*e* represents the case where the plate 2 and the receptacle 4 are assembled by pinching using a clip 18. This clip 18, in the shape of a U in the plane of the Figure, with the arms of the U pressing respectively on the upper face 30 of the plate 2 and on the lower face 31 of the receptacle 4, here holds the plate 2 and the receptacle 4 together. The plate 2 and the receptacle 4 are centered on one another by 25 virtue of, on the one hand, a boss 20 integral with the plate 2, this boss 20 penetrating inside the passage 7 and, on the other hand, two re-entrant parts 32*a* and 32*b* of the clip 18, each of these parts being located on one arm of the U on either side of the passage 7.

FIGS. 5*b* to 5*d* represent different fixing means possible in the embodiment of the invention in which the container 1 is equipped with a base piece 5. In these circumstances, the holding passage or passages 7 consist of a single cylinder 23.

FIG. 5*b* represents the case in which the plate 2, the receptacle 4 and the base piece 5 are joined together by means of individual pins 24, each of these pins 24 being equipped at its lower end with a washer 25. An individual pin 24 corresponds with each passage 7. In these circumstances, the base piece 4 includes, as for FIGS. 1 to 4, a holding passage 50 made in two cylindrical parts, an upper part 52 and a lower part 53, these two parts defining a stop 54 arranged coaxial with the passage 7. The pin 24 passes through the passages 7 and 50 and holds the base piece 5 and the receptacle 4 together with the aid of the washer 25 which bears against the stop 54.

FIGS. 5*c* and 5*d* together represent a configuration for assembling the components by snap-fastening. The attachment foot 6 here consists of a small peg 14, the end of which is a cylinder 15. FIG. 5*c* is a section taken on a plane which is perpendicular to, and bisects, the cylinder 15 of the peg, i.e. on the plane represented by the line 5C—5C of FIG. 5*d*, and FIG. 5*d* is a section taken on the line 5D—5D of FIG. 5*c*. The base piece 5 is also equipped with an attachment foot 16 including two clips 17 which snap-fasten over the cylinder 15, thereby trapping it. This assembling of the plate 2 and the base piece 5 takes place inside the passage 7, the plate 2 and the base piece 5 sandwiching the receptacle 4.

Figure 6:
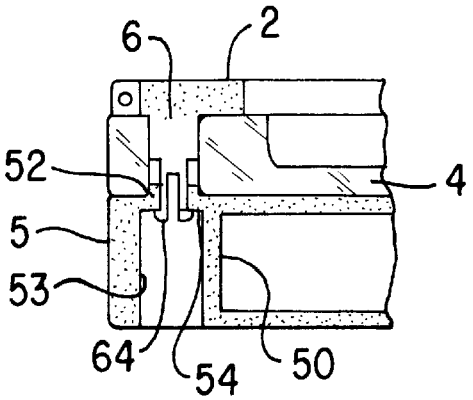
FIG. 6 is a representation of the system for attaching the elements of the container according to the invention when this container further includes a base piece equipped with a storage housing or with a drawer.

FIG. 6 represents the assembling of the plate 2 and the receptacle 4 by snap-fastening in the case where the base piece 5 includes, for example, a storage housing or a drawer. As in FIG. 5*b*, the base piece 5 includes a passage 50 in two cylindrical parts, an upper part 52 and a lower part 53, these two parts defining a stop 54 situated coaxial with the passage 7. The attachment foot 6 includes a cylindrical part, the outwardly curved end of which forms a cylindrical skirt 64 which bears against the stop 54. The receptacle 4 is, here again, sandwiched between the plate 2 and the base piece 5.

Figure 7:
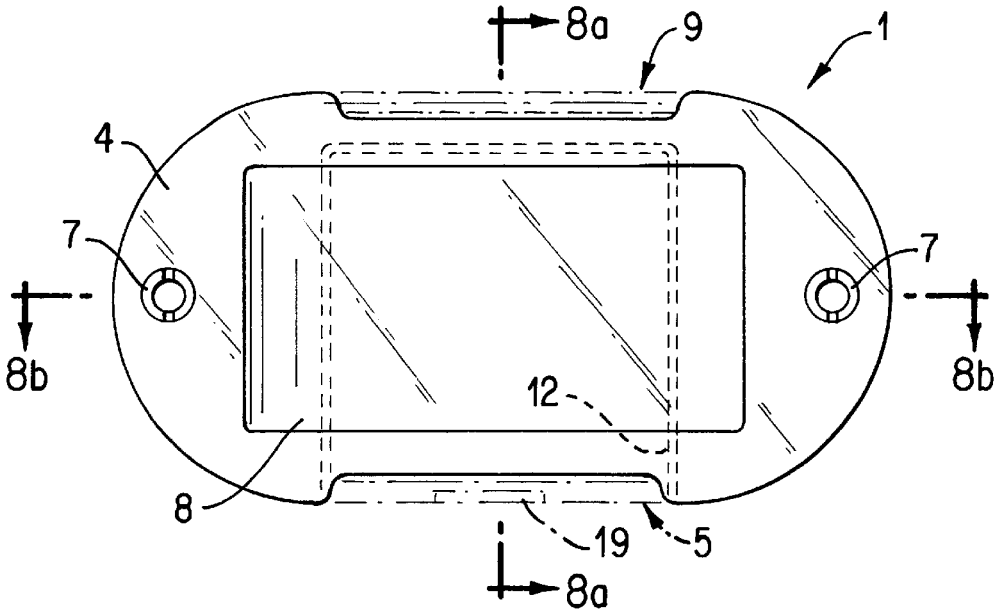
FIG. 7 is a representation of an oval embodiment of the container of the invention with two holding passages and with a drawer.

FIG. 7 is a plan view of the container 1 when the receptacle 4 has the shape of an ellipse, the base piece 5 including a drawer 12. The receptacle 4 has just two hollow shafts for holding which are arranged, in particular, on the major axis of the ellipse, each one being in a rounded part at the two ends of the ellipse.

Figure 8A:
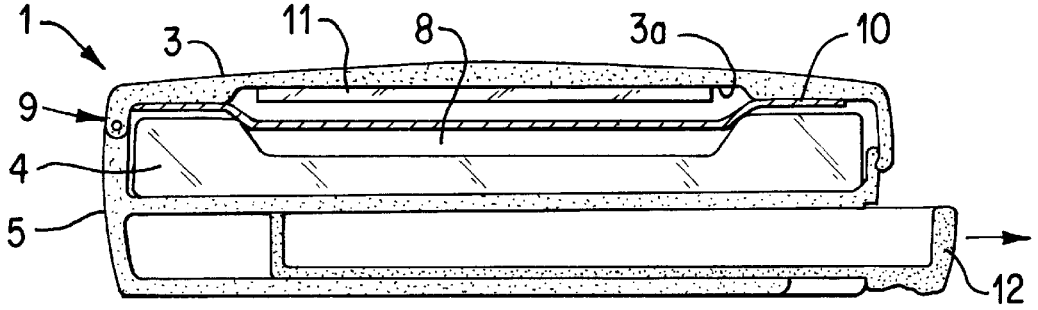
FIGS. 8A and 8B are sectional views of the device taken lines 8A—8A and 8B—8B, respectively, of FIG. 7, and represent another way of fixing the elements of the container together.
Figure 8B:
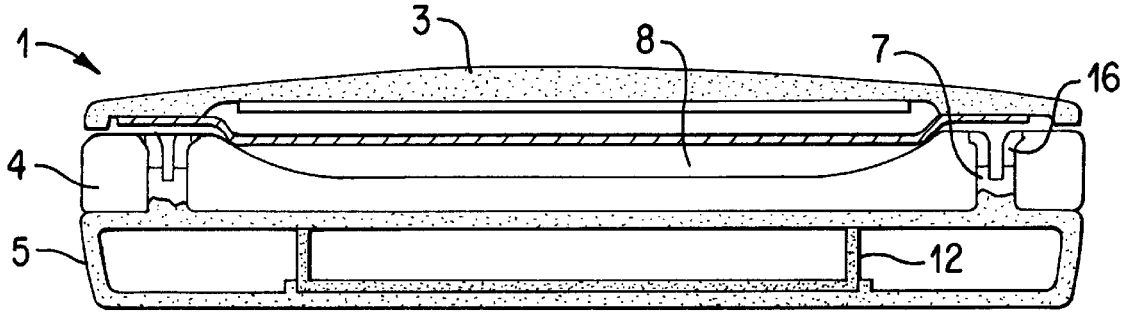

FIGS. 8*a* and 8*b* are sectional views taken on the respective section lines 8A—8A and 8B—8B of FIG. 7. They show the plate 2 and the lid 3 coincident and attached to the base piece 5 by the hinge 9. The container 1 here includes a drawer 12 represented open in FIG. 8*a*. The receptacle 4 is integral with the base piece 5 by virtue of the attachment feet 16 of the base piece 5 which are snap-fastened into the passage 7 of the receptacle 4.

Under these circumstances, the receptacle 4 can easily be detached from the base piece 5 and therefore from the container 1 by pinching each attachment foot using tweezers for example, or between two fingernails. The receptacle can thus constitute a refill and be replaced as desired.

This operation is also possible when the plate, the receptacle and, as appropriate, the base piece are held together by pinching with a clip as is the case in FIG. 5*e*. All that is then required is for the clip to be opened, by lifting one of its legs using a blade, and for the receptacle to be changed.

Changing the receptacle may also be possible for any container according to the invention in which the plate, the receptacle and the base piece are held together by snap-fastening.

The container according to the invention is therefore a modular container. Such an embodiment of the invention is particularly beneficial when the plate 2, the lid 3 and any base piece 5 are made of a precious metal.

Figure 9:
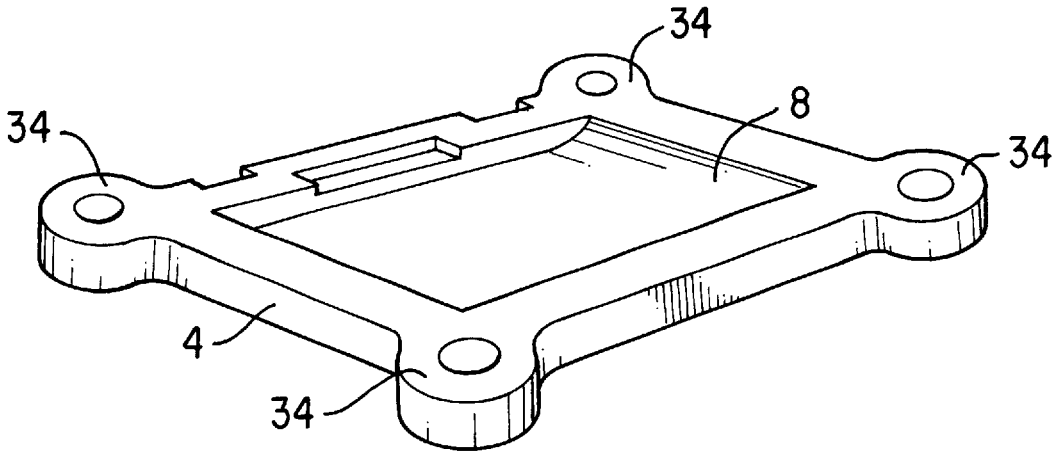
FIG. 9 represents an embodiment of the receptacle of the container according to the invention in which the holding passages are no the outside.

FIG. 9 is a perspective view of a specific embodiment of the receptacle 4 in which the passage 7, by contrast with FIGS. 1 to 4, form outgrowths or external towers 34, like the towers of the ramparts of fortified castles, giving the container an attractive aesthetic appearance. During the process of manufacturing such a container, the four external towers 34 are made in a simple way at the same time as the receptacle from glass or from resin by molding within the same mold.

Figure 10:
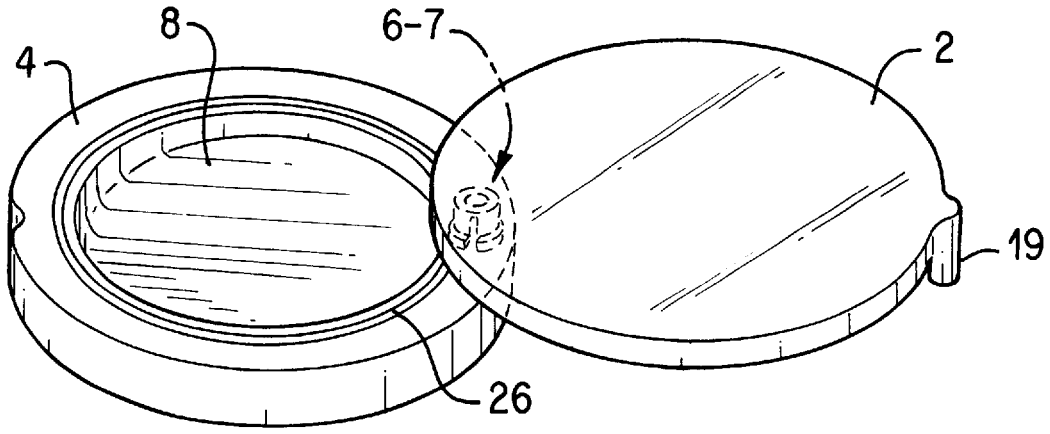
FIG. 10 represents an alternative form of the invention in which the container has a circular shape.

In another embodiment of the invention represented in FIG. 10 the receptacle 4 is of circular shape and has a passage 7 mounted at the periphery of the receptacle 4 passing through it: the container 1 can then be equipped with a circular seal 26 between the plate 2, coinciding with the lid, and the receptacle 4. This O-ring 26 provides a seal between the plate 2 and the receptacle 4. The passage 7 can then allow the plate 2 to be rotated laterally. The clasp 19 here is formed of a catch incorporated into the plate, this catch being positioned in a cut edge provided in the receptacle 4 in order to close the container.

What is claimed as new and desired to be secured by Letters Patent of the United States is:

1. Arrangement for packaging a cosmetic product, including a container comprising a receptacle having an upper and lower face and at least one passage extending from said upper face to said lower face, a plate which is engageable with said upper face of said receptacle, and a mechanism fixing the plate on the receptacle wherein the receptacle is transparent and is free of undercuts wherein the fixing mechanism is connected to said plate and at least partially projects into and is secured within said passage.

2. Packaging arrangement according to claim 1, wherein the receptacle comprises one of a glass material and a case resin material.

3. Packaging arrangement according to claim 2, wherein the receptacle comprises glass.

4. Arrangement according to claim 1, wherein the fixing mechanism includes at least one attachment foot integral with the plate.

5. Packaging arrangement according to claim 4, wherein the receptacle and the plate are held together by an attachment foot of the plate, which is snap-fastened into said passage of the receptacle.

6. Arrangement for packaging a cosmetic product, including a container comprising a receptacle, a plate and a mechanism fixing the plate on the receptacle wherein the receptacle is transparent and is free of undercuts wherein the fixing mechanism includes at least one passage formed in and passing through the receptacle wherein the passage comprises two cylindrical parts which include an upper part and a lower part, the diameter of the upper cylindrical part being smaller than that of the lower cylindrical part.

7. Packaging arrangement according to claim 1, which includes a base piece.

8. Packaging arrangement according to claim 7, wherein the base piece includes at least one holding passage.

9. Packaging arrangement according to claim 1, which comprises a lid.

10. Packaging arrangement according to claim 9, wherein the lid has a mirror on an internal face thereof.

11. Packaging arrangement according to claim 9, which comprises a cover for protecting the product, said cover being sandwiched between the plate and the lid.

12. Packaging arrangement according to claim 5, wherein the receptacle is removable and replaceable by a similar receptacle.

13. Packaging arrangement according to claim 9, which comprises a hinge located between the lid and the plate.

14. Packaging arrangement according to claim 1, which includes a clasp.

* * * * *